United States Patent [19]

Landa

[11] Patent Number: 4,585,329

[45] Date of Patent: Apr. 29, 1986

[54] PLATEN COVER ASSEMBLY FOR COPIER

[75] Inventor: Benzion Landa, Edmonton, Canada

[73] Assignee: Savin Corporation, Stamford, Conn.

[21] Appl. No.: 552,360

[22] Filed: Nov. 16, 1983

Related U.S. Application Data

[62] Division of Ser. No. 268,261, May 29, 1981, Pat. No. 4,435,068.

[51] Int. Cl.[4] ..... G03G 21/00

[52] U.S. Cl. ..... 355/3 R; 355/75; 355/133

[58] Field of Search ..... 355/3 R, 21, 75, 133

[56] References Cited

U.S. PATENT DOCUMENTS 3,615,134 10/1971 Newcomb ..... 355/75

3,717,411 2/1973 Niesen et al. ..... 355/75

4,128,334 12/1978 Yanagawa et al. ..... 355/75

*Primary Examiner*—Fred L. Braun

*Attorney, Agent, or Firm*—Shenier & O'Connor

[57] ABSTRACT

A copy machine cabinet and lid construction in which the lid is carried by the cabinet for a swinging movement from a position over the cabinet top to a position away from the cabinet top. This lid is provided with a platen adapted to receive an original and with a platen cover which is mounted for a swinging movement between a position over the platen and a position away from the platen. As the lid is moved to a position to permit access to the parts within the cabinet, gravity responsive locks inhibit movement of the platen cover away from the platen.

1 Claim, 7 Drawing Figures

PLATEN COVER ASSEMBLY FOR COPIER

This is a division of application Ser. No. 268,261, filed May 29, 1981, now U.S. Pat. No. 4,435,068.

FIELD OF THE INVENTION

The invention relates to electrophotographic copiers and more particularly to a platen cover assembly for a copier.

BACKGROUND OF THE INVENTION

Electrophotographic copying machines of the prior art are housed in a cabinet so constructed as to permit access to the parts of the copying machine within the cabinet. Many of these copying machines include a glass platen on top of the machine on which an original is placed face down to permit a reciprocating optical system within the cabinet to scan the document. Customarily a platen cover is positioned on top of the cabinet for movement between a position at which the platen is exposed and a position at which the cover holds the original down onto the platen. It is desirable that the machine cabinet be provided with a lid adapted to be swung to an open position for access to the enclosed parts of the machine. If this is done, however, it creates the problem that the platen cover or the like may flop freely away from the lid when the lid is moved to a fully open position.

I have invented an arrangement which overcomes the problem outlined above. My construction automatically prevents the platen cover or the like from falling freely away from the machine lid when the latter is moved to its fully open position. My arrangement accomplishes this result in a simple and expeditious manner.

SUMMARY OF THE INVENTION

One object of my invention is to provide a platen cover assembly for a copier with a simple and expeditious arrangement for preventing the platen cover or the like from falling away from the platen when the cabinet lid is moved to a fully open position.

Another object of my invention is to provide an improved electrophotographic apparatus having means for automatically preventing the platen cover from falling away from the platen when the machine lid is moved to fully open position.

Other and further objects of may invention will appear from the following description.

BRIEF DESCRIPTION OF THE DRAWINGS

In the accompanying drawings to which reference is made in the instant specification and which are to be read in conjunction therewith, and in which like reference numerals are used to indicate like parts in the various views.

DESCRIPTION OF THE PREFERRED EMBODIMENT

Figure 1:
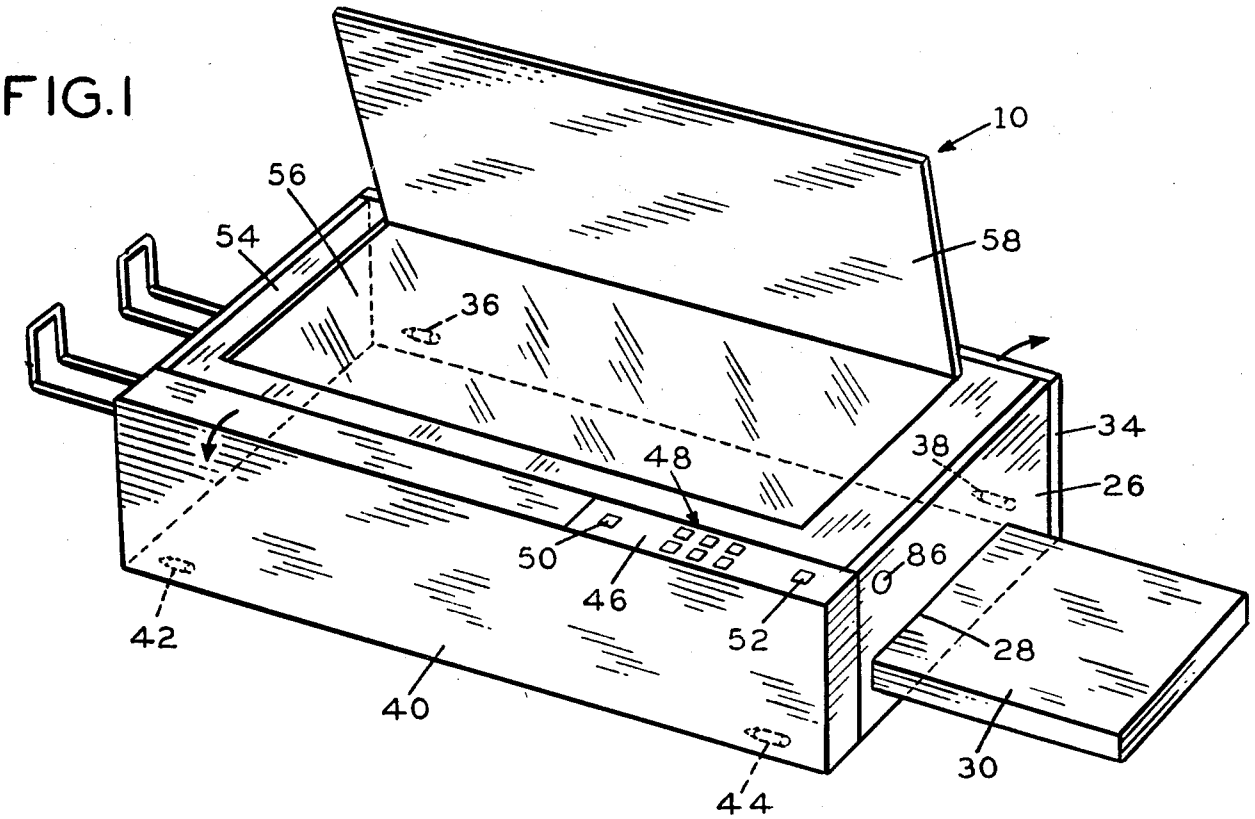
FIG. 1 is a prospective view of my improved apparatus for electrophotography illustrating the overall configuration thereof.
Figures 2, 2A, 2B:
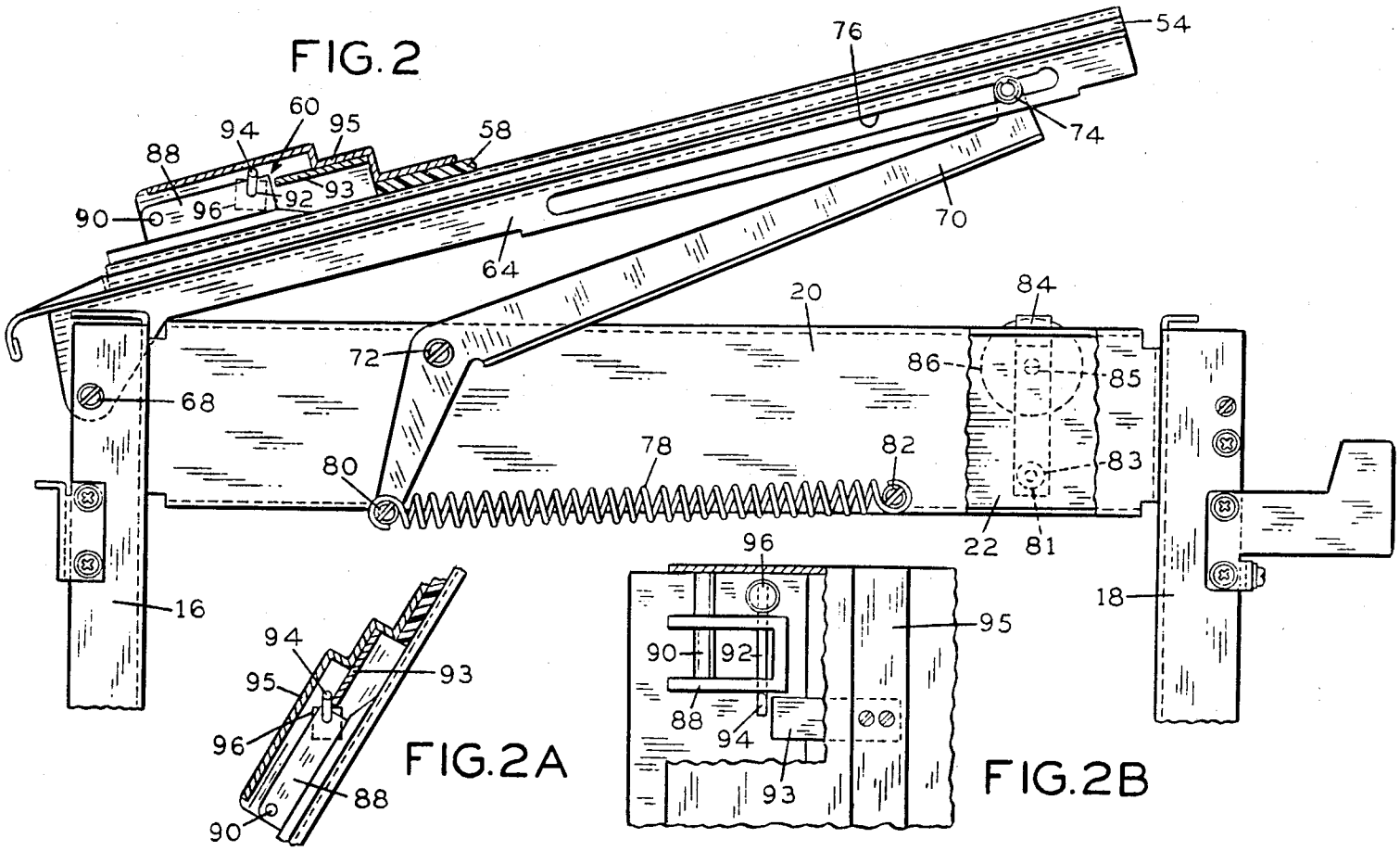
FIG. 2 is a fragmentary side elevation of my improved apparatus for electrophotography with parts broken away and with other parts shown in section to illustrate the details of the machine lid mounting and of the platen cover arrangement.
FIG. 2A is a fragmentary view of the lid of my improved electrophotographic apparatus illustrating the platen cover lock.
FIG. 2B is a fragmentary top plan of a portion of the lid of my improved electrophotographic apparatus with parts broken away and with other parts in section.
Figures 3, 4:
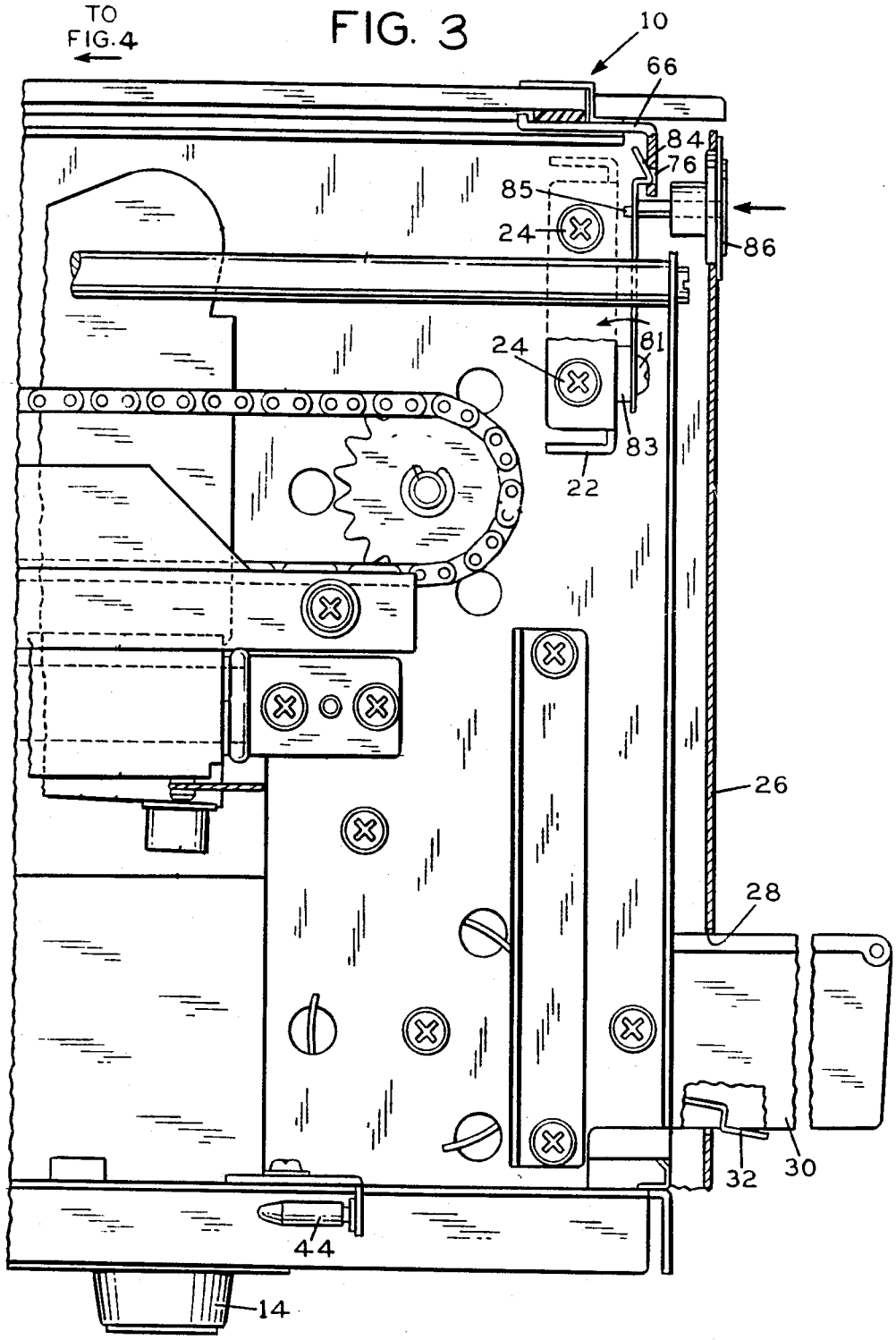
FIG. 3 is a fragmentary elevation of the right front of my improved apparatus for electrophotography drawn on an enlarged scale.
FIG. 4 is a fragmentary elevation of the front central portion of my improved apparatus for electrophotography drawn on an enlarged scale with some parts broken away.
Figure 4:
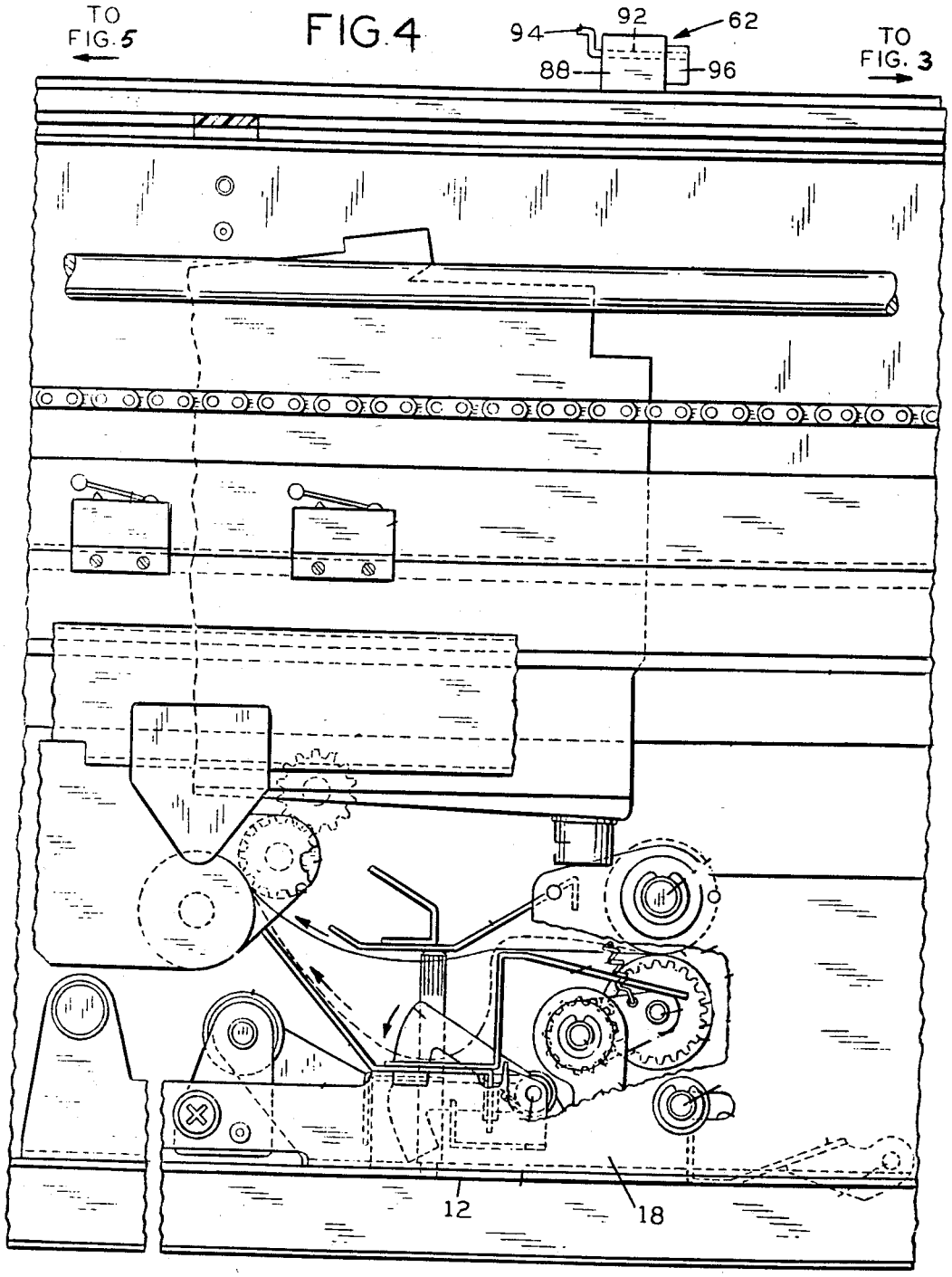
Figure 5:
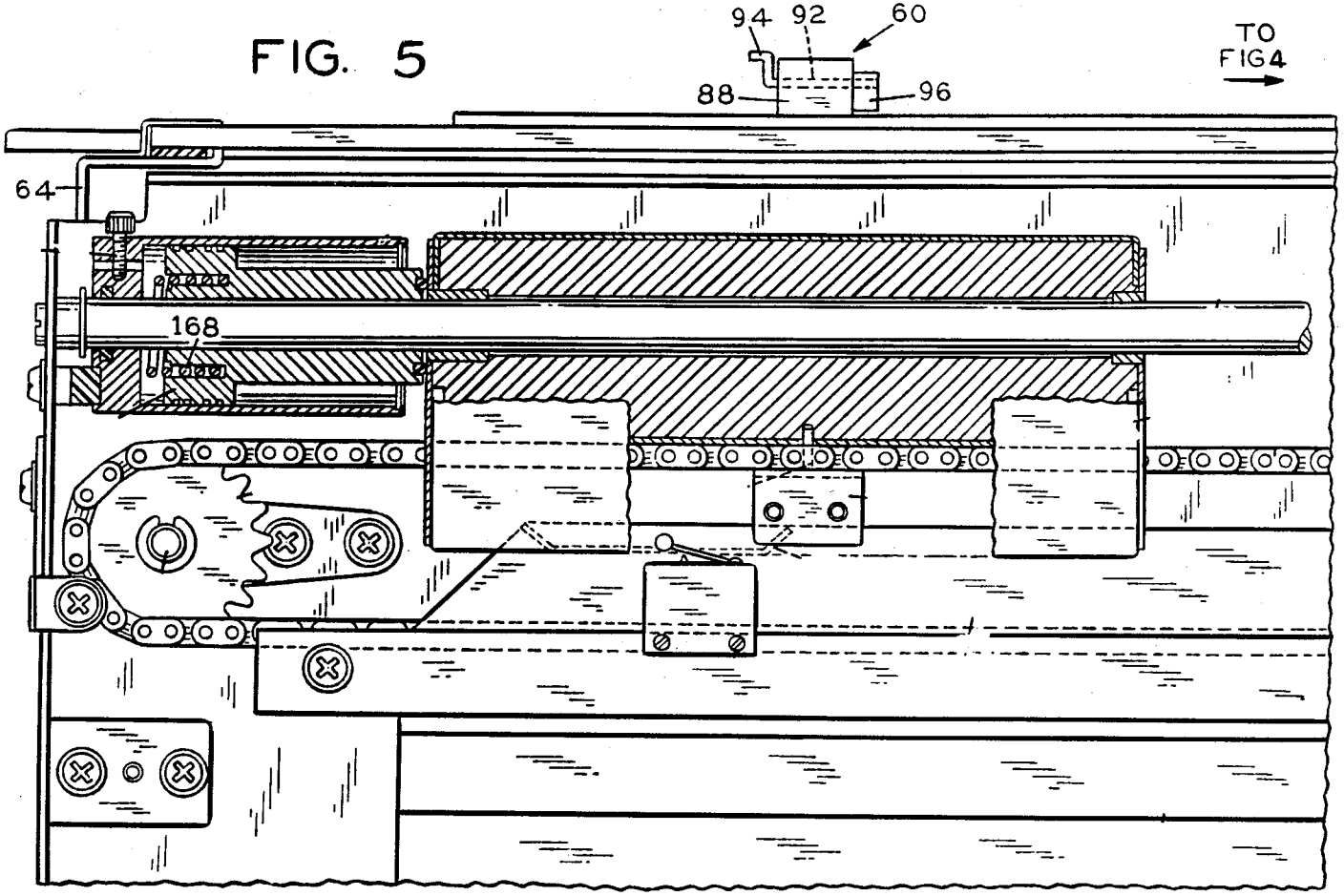
FIG. 5 is a fragmentary elevation of the upper left-hand portion of my improved apparatus for electrophotography drawn on an enlarged scale with parts broken away and with other parts shown in section.

Referring now to FIGS. 1 to 5 of the drawings, my improved apparatus for electrophotography indicated generally by the reference character 10, includes a base 12 supported by a plurality of feet 14. A rear wall 16 and a front wall 18 extending upwardly from the base 12 are connected at the upper left ends thereof by a first crosspiece 20 and at the upper right ends thereof by a second crosspiece 22. Any suitable means, such for example as screws 24, may be employed to secure the crosspieces to the front and rear walls 18 and 16.

My machine includes a right end cover 26 secured to the front and rear walls by any suitable means such as screws or the like. Cover 26 has an opening 28 through which a cassette 30 containing a supply of paper can be inserted into the machine in a manner to be described hereinbelow. The cassette 30 includes a paper support plate 32 which normally rests on the bottom of the cassette and which is acted upon in a manner to be described hereinbelow to bring the uppermost sheet of paper in the cassette into engagement with a paper feed roll to be described.

A rear cover 34 of my machine 10 is pivotally supported on a pair of hinge pins 36 and 38, carried by brackets on rear wall, for movement between a closed position and an open position. Any suitable means known to the art, such for example as magnets (not shown) may be employed to hold the rear cover in its closed position. Similarly, any suitable means such for example as chains (not shown) may be employed to limit the opening movement of the rear cover.

My machine includes a front cover 40 pivotally supported on respctive hinge pins 42 and 44 carried by the front wall 18. As with the rear cover 34, any suitable means such for example as magnets (not shown) may be employed to hold the front cover in its closed position while any means such for example as chains (not shown) may be employed to limit the movement of the cover to its open position.

In the particular embodiment of my invention illustrated in the drawings, the front cover 40 may act as a housing for the electronics package associated with the machine. The upper surface of the cover 40 carries a control panel 46 provided with suitable push buttons and the like for controlling the operation of the machine. For example, a first battery indicated generally by the reference character 48 of buttons may be operated to set the machine to make a predetermined number of copies. A switch 50 in the keyboard 46 may be provided to permit the operator to select one of a number of cassettes associated with the machine in a manner to be described hereinbelow. A pushbutton 52 may be actuated to initiate the operation of the machine. In addition, panel 46 may be provided with a display for indicating various conditions, such as exhaustion of the paper supply, the condition of the developer and the like to be described.

My machine 10 includes a lid 54 carrying a glass platen 56 upon which the original to be copied may be placed face down during the copying operation. A platen cover 58 is supported by a pair of gravity locking hinges indicated generally by the respective reference characters 60 and 62 for movement between a position away from the platen to permit a document to be placed face down thereon and a position at which it covers the document. Respective lid supporting arms 64 and 66 receive pivot pins 68 carried at the respective ends of the rear bulkhead so as to support the lid and the platen carried thereby for movement from closed position, at which the lid lies flat, to an open position at which all of the operating parts of the machine are readily accessible in a manner to be described more fully hereinbelow.

The crosspieces 20 and 22 carry respective pivot pins 72 supporting bell cranks 70 associated with the respective arms 64 and 66. The end of one arm of each bell crank 70 carries a roller 74 which is adapted to ride in a slot 76 in its associated bracket 64 or 66. Respective springs 78 extend between pins 80 on the other arms of the bell cranks and pins 82 on the respective crosspieces 20 and 22, so as to bias the lid 54 to a partially open position. A resilient catch 84 at the front of the machine normally engages arm 66 to hold the lid 54 closed against the action of springs 78. More specifically, a screw 81 and spacer 83 mount the spring finger catch 84 on crosspiece 22 at a position at which it engages in the slot 76 in arm 66 when lid 54 is closed releasably to hold the lid down against the action of springs 78. A pushbutton 86 mounted in a bezel in cover 26, is adapted to be actuated to cause a rod 85 to release the catch 84 to permit the springs 78 to move the lid 54 to its partially open position. When that occurs, the operator can readily manually move the lid to its fully open position as determined by the length of the slots 76 or by limit chains (not shown). With the lid in this position, the gravity responsive hinges 60 and 62 prevent the cover 58 from falling backwardly away from the platen 56.

Each of the gravity locking hinges 62 includes a bracket 88 secured to the lid 54. A pivot pin 90 on each bracket 88 is received in a bracket 95 secured to cover 58 so as normally to permit the operator to swing the platen cover 58 upwardly away from the platen 56. Each hinge 60 and 62 also includes a shaft 92 pivotally supported on the bracket 88 at a location forward of the pivot 90. One end of the shaft 92, extending outwardly of the bracket 88 is formed with an offset 94. The other end of the shaft 92 extending outwardly of the bracket carries a weight 96. I secure respective stop plates 93 to the underside of a step in bracket 95 to form pockets adjacent to the respective offsets 94.

When the lid 54 is in its normal closed position in which it is generally horizontal, as the platen cover 58 is swung upwardly around the pivot pins 90 offsets 94 clear the pockets formed by plates 93. It will readily be appreciated that when lid 54 together with cover 58 is swung open, weight 96 and the offset 94 tend to remain in the same position under the influence of gravity. Ultimately offsets 94 move into the pockets formed by plates 93 to prevent cover 58 from pivoting around the pins 90. Stated otherwise, as the lid 54 is moved to its fully open position the gravity locks 60 and 62 prevent the platen cover 58 from swinging away from the lid 54.

It will be seen that I have accomplished the objects of my invention. I have provided a platen cover assembly for a copying machine which prevents the platen cover or the like from falling away from the machine lid when the lid is moved to fully open position. I provide my machine with a lid adapted to be opened and with a gravity sensitive lock for preventing the platen cover from falling away from the platen when the lid is moved to a fully opened position.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Copying apparatus including in combination, a cabinet adapted to house the operating components of said apparatus, said cabinet having an open top, a lid, means mounting said lid on said cabinet for pivotal movement around a first horizontal axis between a closed position over the open top of said cabinet and an open position at which the interior of said cabinet is accessible, a platen in said lid for supporting a document to be copied, a platen cover, means mounting said cover on said lid for pivotal movement around a second horizontal axis parallel to said first axis between a first position at which said platen is covered and a second position at which said platen is exposed, interengageable elements on said lid and on said cover, said elements being movable between a first relative position out of engagement at which they permit relative movement of said lid and cover and a second relative position in engagement at which they inhibit relative movement of said lid and cover, said elements occupying said first relative position with said lid adjacent to said top, and gravity responsive means for moving said elements to said second relative position as said lid moves away from said top.

* * * * *